US006270313B1

(12) United States Patent
Chuang et al.

(10) Patent No.: US 6,270,313 B1
(45) Date of Patent: Aug. 7, 2001

(54) FAN AND AIRFLOW FOR COOLING ELECTRONIC DEVICE WITH REDUCED TURBULENCE AND NOISE AND HIGHER EFFICIENCY

(75) Inventors: Te-Tsai Chuang, Miao Li; Kuo-Cheng Lin, Taoyuan, both of (TW)

(73) Assignee: Delta Electronics, Inc., Taipei (TW)

( * ) Notice: Subject to any disclaimer, the term of this patent is extended or adjusted under 35 U.S.C. 154(b) by 0 days.

(21) Appl. No.: 09/347,705

(22) Filed: Jul. 3, 1999

Related U.S. Application Data

(60) Provisional application No. 60/091,714, filed on Jul. 4, 1998.

(51) Int. Cl.[7] ..... F01D 17/12

(52) U.S. Cl. ..... 415/148; 415/121.2; 415/203; 415/149.1

(58) Field of Search ..... 415/148, 151, 415/121.2, 203, 205, 220, 149.1, 215.1, 201, 213.1; 417/423.7, 423.14, 423.1, 423.8, 424.1, 234, 415–417

(56) References Cited

U.S. PATENT DOCUMENTS

| | | | | |
|---|---|---|---|---|
| 1,187,400 | * | 1/1916 | Taylor | 415/148 |
| 2,037,857 | * | 4/1936 | Fox | 415/148 |
| 2,300,475 | * | 11/1942 | Ward | 415/121.2 |
| 3,362,469 | * | 1/1968 | Berner et al. | 415/148 |
| 3,481,534 | * | 12/1969 | Price | 415/148 |
| 3,486,831 | * | 12/1969 | Miele | 415/148 |
| 5,979,541 | * | 11/1999 | Saito | 417/423.14 |

* cited by examiner

*Primary Examiner*—Edward K. Look
*Assistant Examiner*—Richard Woo
(74) *Attorney, Agent, or Firm*—Bo-In Lin

(57) ABSTRACT

The present invention discloses a cooling system for temperature control, e.g., removing heat from electronic circuits. The cooling system includes a fan and an airflow guiding system where the guiding system includes an inlet air duct for guiding the airflow to the fan. The inlet air duct includes turbulence reduction grid for separating the air duct into a plurality of isolated flow path whereby the air turbulence is reduced. In a preferred embodiment, the airflow guiding system further includes an outlet duct for incorporating the fan therein wherein the outlet portion and the fan are directed to a direction different from the inlet air duct for guiding the airflow to the fan. In another preferred embodiment, the outlet duct and the fan are directed to a direction perpendicular to the inlet air duct for guiding the airflow to the fan. And, the inlet air duct and the outlet duct are connected via a corner duct-connector having a blunted corner angle for smoothing and reducing airflow turbulence flowing there through. In another preferred embodiment, the fan having a rotational shaft hung to the corner duct-connector whereby the fan is structurally supported only on the rotational shaft for reducing air turbulence. In another preferred embodiment, the fan includes a plurality of blades wherein the blades are configured to have a bending blade surface constituting same direction screw shape for reducing airflow turbulence. In another preferred embodiment, the blades are formed with a notch at a front end of the blades to reduce a reverse flow due to air resistance for further reducing airflow turbulence. In another preferred embodiment, the inlet air duct further includes other openings for increasing a flow rate of the airflow to improve the cooling efficiency.

20 Claims, 2 Drawing Sheets

FAN AND AIRFLOW FOR COOLING ELECTRONIC DEVICE WITH REDUCED TURBULENCE AND NOISE AND HIGHER EFFICIENCY

This Application claims a Priority Date of Jul. 4, 1998, benefited from a previously filed Provisional Application No. 60/091,714 filed on Jul. 4, 1998 by the same Inventors of this Patent Application.

BACKGROUND OF THE INVENTION

1. Field of the Invention

This invention relates generally to a cooling system for electronic devices. More particularly, this invention relates to a cooling system having a fan of a new configuration arranged to produce a cooling airflow passing through a novel flow-field with reduce turbulence, lower noise and high cooling efficiency.

2. Description of the Prior Art

One of the major limitations to further improve the performance and configuration design of the modern electronic devices is a requirement of heat removal and temperature control of the electronic devices. The heat removal design of an electronic device according to a temperature control requirement imposes space limitation and power supply requirement. Additionally, if a fan is employed, the noise generated from the operation of a fan must also be controlled and reduced.

The demand for improving the heat removal system is ever increased as the electronic devices become further miniaturized and the electronic circuits are manufactured with ever-increased density and required for operation at higher speed and consuming less power. As the electronic circuits are more densely integrated, higher rate of heat generation per unit volume is required for removal. On the other hand, a more stringent temperature control is necessary because the performance of the electronic circuits with higher performance levels tend to be more temperature sensitive. In the meantime, this more stringent temperature control requirement has to be satisfied with smaller spaces available for placement of the cooling system because now the electronic devices and also the air-moving devices are further miniaturized.

The most direct consideration for improving the heat removal performance for an air moving device is to consider the fan and the cooling airflow passing through the electronic circuits for removing the heat. FIGS. 1A and 1B shows a fan that is most commonly employed in cooling the electronic devices. The directions of the inlet and the outlet of the airflow are arranged in parallel. The blades of the fan are rotated along an axis perpendicular to the plane of the blades and in parallel to the airflow direction. This configuration produces a direct pressure difference between the inlet and outlet of the airflow thus provides large airflow for cooling and removing the heat generated from the electronic circuits. This configuration however results in several difficulties. The first difficulty is its inflexibility in arranging the cooling system. Optimal space arrangement may be difficult due to the need to arrange the inlet and outlet of the flow to direct the airflow to the electronic circuits. Additional difficulties are caused by the turbulent characteristics generated in the flow field. The rotation of the fan blades generates a turbulent flow not only in the air near the fan blades but also the turbulent characteristics are propagated to the entire airflow path from the inlet to the outlet of this cooling system. The turbulent characteristics in the flow field affect the stability of the airflow, the efficiency of the fan operation and also cause the noise to increase.

Therefore, a need still exists for a new system configuration and design method in the art of cooling system applying a fan and the airflow ducts to resolve these difficulties and limitations. More particularly, this new system configuration and design approach must be able to reduce the turbulence of the flow-field in the airflow path. By reducing the turbulence of the flow-field, more stable and smooth airflow is generated at higher fan efficiency. Furthermore, the noise of the fan can be reduced when the turbulence of the flow field is reduced.

SUMMARY OF THE PRESENT INVENTION

It is therefore an object of the present invention to provide a cooling system includes an air flow guiding system and a fan to provide flexible space arrangement and reduced turbulence of the flow field to overcome the aforementioned difficulties encountered in the prior art.

Specifically, it is an object of the present invention to provide a cooling system includes an airflow guiding system and a fan where the airflow guiding system allows the directions of the inlet and the outlet airflow to be in different non-parallel directions to allow flexible space arrangement. Furthermore, the airflow guiding system is provided with turbulence isolation partition such that the turbulence of the flow-filed is reduced.

Another object of the present invention is to provide a cooling system includes a air flow guiding system and a fan where the airflow guiding system is formed with ducts designed with configuration to minimize airflow reflection thus reduces the flow-field turbulence.

Another object of the present invention is to provide a cooling system includes an airflow guiding system and a fan where the fan is provided with a motor hanging from the wall of a duct in the airflow guiding system. The noise is reduced because the ribs for supporting the fan blades are no longer required and the noises from interference between the airflow and ribs are eliminated.

Another object of the present invention is to provide a cooling system includes a air flow guiding system and a fan where the blades of the fan are configured to have continuous screw shape between adjacent blades to minimize the turbulence generated from the rotation of these blades.

Another object of the present invention is to provide a cooling system includes a air flow guiding system and a fan where the blades are provided with notches at the front end of the blades. The reverse flow of the airflow due to a resistance to the blade rotation can be minimized such that the airflow turbulence can be further reduced.

Another object of the present invention is to provide a cooling system includes a air flow guiding system and a fan where the additional air intake openings are provided in the airflow guiding system such that the flow rate ban be increased. A higher cooling rate can be achieved by increasing the flow rate produced by the cooling system.

Briefly, in a preferred embodiment, the present invention discloses a cooling system for temperature control, e.g., removing heat from electronic circuits. The cooling system includes a fan and an airflow guiding system where the guiding system includes an inlet air duct for guiding the airflow to the fan. The inlet air duct includes turbulence reduction grid for separating the air duct into a plurality of isolated flow path whereby the air turbulence is reduced. In a preferred embodiment, the airflow guiding system further includes an outlet duct for incorporating the fan therein wherein the outlet portion and the fan are directed to a direction different from the inlet air duct for guiding the airflow to the fan. In another preferred embodiment, the outlet duct and the fan are directed to a direction perpendicular to the inlet air duct for guiding the airflow to the fan. And, the inlet air duct and the outlet duct are connected via a corner duct-connector having a blunted corner angle for smoothing and reducing airflow turbulence flowing there through. In another preferred embodiment, the fan having a rotational shaft hung to the corner duct-connector whereby the fan is structurally supported only on the rotational shaft for reducing air turbulence. In another preferred embodiment, the fan includes a plurality of blades wherein the blades are configured to have a bending blade surface constituting same direction screw shape for reducing airflow turbulence. In another preferred embodiment, the blades are formed with a notch at a front end of the blades to reduce a reverse flow due to air resistance for further reducing airflow turbulence. In another preferred embodiment, the inlet air duct further includes other openings for increasing a flow rate of the airflow to improve the cooling efficiency.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1A:
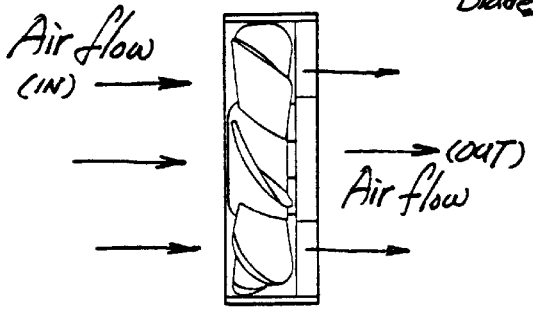
FIG. 1A (Prior art)
FIGS. 1A and 1B are respectively a side view and a top view of a fan in a conventional cooling system for removing heat from electronic circuits most commonly employed.
Figure 1B:
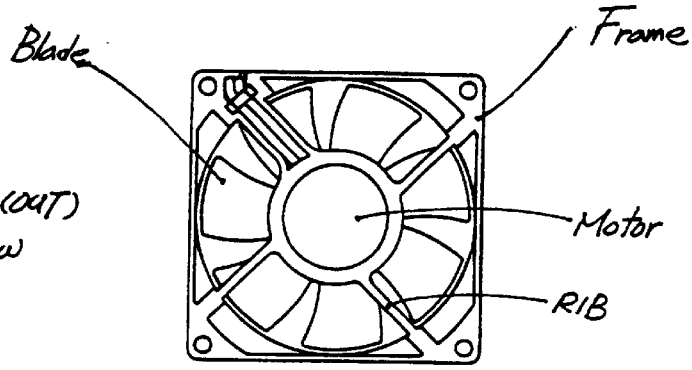
FIG. 1B (Prior Art)
Figure 2B:
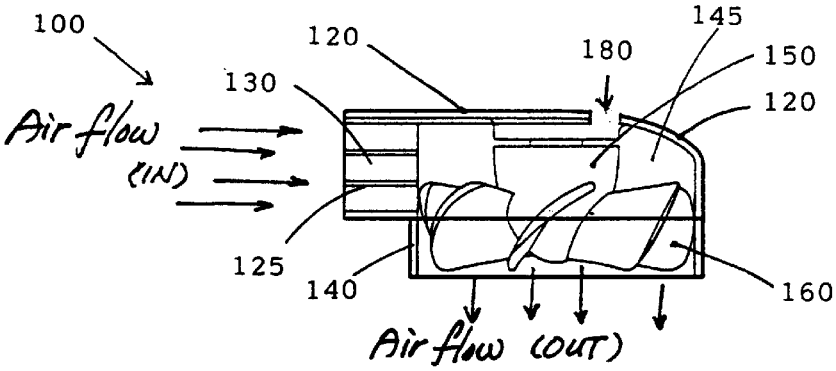
FIGS. 2A to 2C are respectively a front-end side view and rear-end side view and top view of the cooling system of this invention.
Figure 2A:
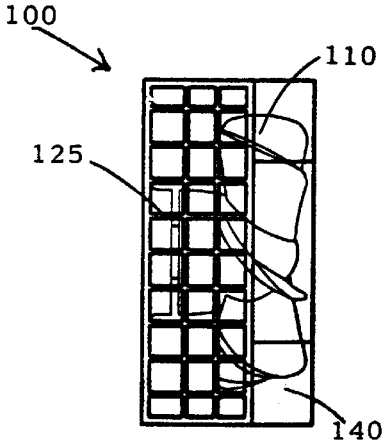
Figure 2C:
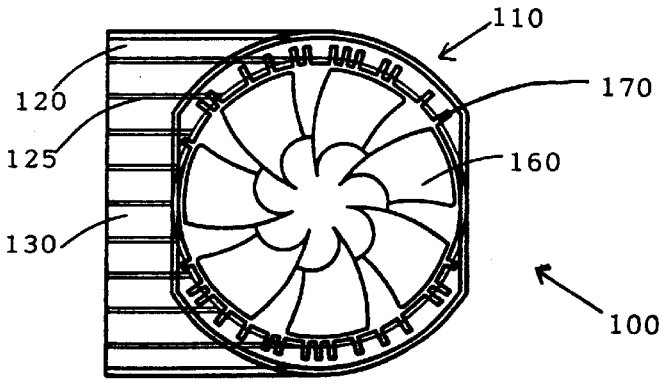

Referring to FIGS. 2A to 2C for a front-side view, rear-end side view and top view respectively of a cooling system 100 of this invention. The cooling system 100 includes a fan 110 and an airflow guiding system where the guiding system includes an inlet air duct 120 for guiding the airflow to the fan 110. The inlet air duct 120 includes turbulence reduction grid 125 for separating the air duct into a plurality of isolated flow path 130 whereby the air turbulence is reduced. The airflow guiding system further includes an outlet duct 140 for incorporating the fan 110 therein wherein the outlet duct 140 and the fan 110 are directed to a direction different from the inlet air duct 120 for guiding the airflow to the fan 110. As shown in FIG. 2B, the outlet duct 140 and the fan 110 are directed to a direction perpendicular to the inlet air duct 120 for guiding the airflow to the fan 110. And, the inlet air duct 120 and the outlet duct 140 are connected via a corner duct-connector 145 having a blunted corner angle for smoothing and reducing airflow turbulence flowing there through. As shown in FIGS. 2B and 2C, the fan 110 having a rotational shaft 150 hung to the corner duct-connector 145 whereby the fan is structurally supported only on the rotational shaft 150 for reducing air turbulence. As shown in FIGS. 2B and 2C, the fan includes a plurality of blades 160 wherein the blades 160 are configured to have a bending blade surface constituting same direction screw shape for reducing airflow turbulence. Also, a rotatable outlet ring 180 (to be described below) has a plurality of notches 170 to reduce a reverse flow due to air resistance for further reducing airflow turbulence. Furthermore, the inlet air duct 120 further includes other openings, e.g., opening 180 as shown in FIG. 2C, for increasing a flow rate of the airflow to improve the cooling efficiency.

Figure 3B:
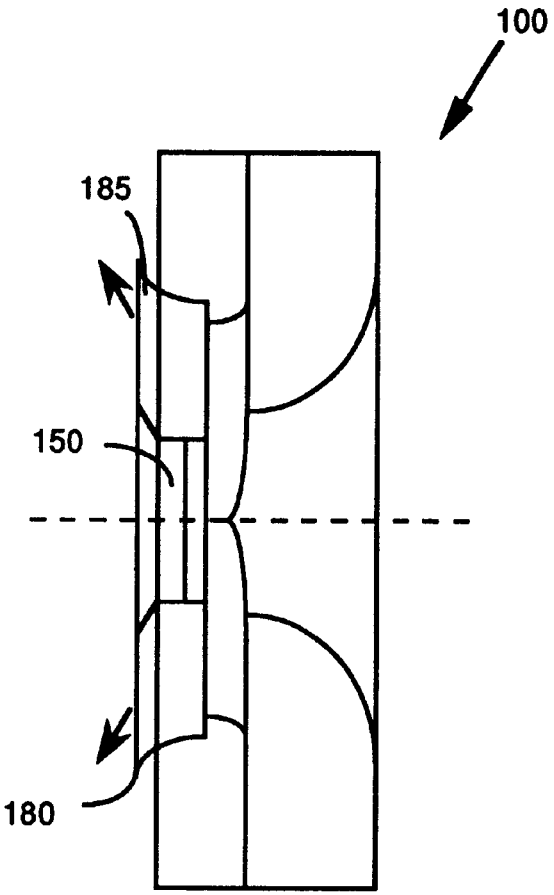
FIGS. 3A and 3B are respectively a bottom view and side view of the cooling system with a fan having an outlet ring with adjustable angular positions of this invention.
Figure 3A:
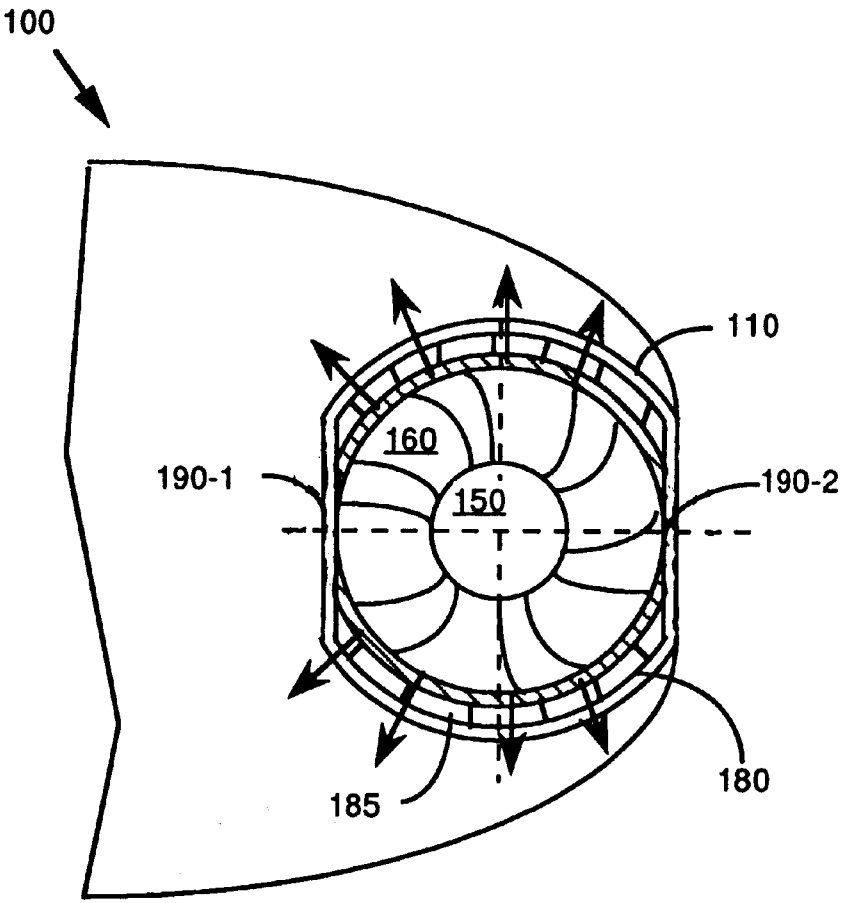

Referring to FIGS. 3A and 3B for a bottom view and a side cross sectional view of an alternate embodiment of the fan 110 of the cooling system 100. The fan 110 further includes a rotatable outlet ring 180. The rotatable outlet ring 180 includes a plurality of adjustable flow guide plates 185 and each of these guide plates can be adjusted to point to different angular direction to direct the flow of the cooling air to direct to particular directions. In this embodiment, the rotatable outlet ring 180 has two symmetrical straight cutoff sections 190-1 and 190-2 to enhance the directional guiding effects of the guiding plates. The directional guidance of the cooling air flow is strengthened by blocking a portion of the flow from these cutoff sections of the outlet ring 180 thus increasing the amount of the cooling air flow directed to flow in particular directions.

According to FIGS. 2 and 3 and the above descriptions, this invention discloses a cooling system 100 for temperature control. The cooling system includes a fan 110 and an airflow guiding system. The guiding system includes an inlet air duct 120 for guiding the airflow to the fan. The inlet air duct includes turbulence reduction grid 125 for separating the air duct into a plurality of isolated flow paths whereby the air turbulence is reduced. In a preferred embodiment, the airflow guiding system further includes an outlet duct 140 for incorporating the fan 110 therein wherein the outlet duct 140 and the fan 110 are directed to a direction different from the inlet air duct 120. In a preferred embodiment, the outlet duct 140 and the fan 110 are directed to a direction perpendicular to the inlet air duct 120. And, the inlet air duct 120 and the outlet duct 140 are connected via a corner duct-connector 145 having a blunted corner angle for smoothing and reducing airflow turbulence flowing there through. In another preferred embodiment, the fan driven by a motor 150 hung to the corner duct-connector whereby the fan is structurally supported only on the motor 150 for reducing air turbulence. In another preferred embodiment, the fan 150 includes a plurality of blades 160 wherein each of the blades 160 are configured to have a bending blade-surface constituting same direction screw shape for reducing airflow turbulence. In another preferred embodiment, a rotatable outlet ring 180 has a plurality of notches 170 to reduce a reverse flow due to air resistance for further reducing airflow turbulence. In another preferred embodiment, the inlet air duct 120 further includes more than one openings for increasing a flow rate of the airflow to improve a cooling efficiency. In another preferred embodiment, the fan 110 having fan-blades 160 disposed substantially on a fan-blade-plane and rotating along a rotation axis, along a vertical axis, e.g., Y-axis. And, the guiding system includes an inlet air duct 120 for guiding an airflow to the fan along a direction substantially parallel to the fan-blade-plane along a horizontal axis, e.g., X-axis, and the fan blowing the airflow out along a direction or the rotation axis, i.e., Y-axis. In another preferred embodiment, the fan further includes a rotatable outlet ring 180 for rotating to an outlet-ring angular position and for directing the airflow blowing out from the fan 110 to predefined directions according to the outlet-ring angular position.

In summary, this invention discloses a cooling system 100 for temperature control. The cooling system includes a fan 110 with fan-blades disposed substantially on a fan-blade-plane along the X-axis, and rotating along a rotation axis, i.e., the Y-axis. The cooling system further includes an airflow guiding system. The guiding system includes an inlet air duct 120 for guiding an airflow to the fan 110 along a direction, i.e., along the X-axis, substantially parallel to the fan-blade-plane and the fan blowing the airflow out along a direction or the rotation axis, i.e., the Y-axis. In a preferred embodiment, the airflow guiding system further includes an outlet duct 140 for incorporating the fan therein and the outlet duct 140 and the fan 110 are directed to a direction, i.e., along the Y-axis, different from the inlet air duct, i.e., along the X-axis. In another preferred embodiment, the inlet air duct 120 and the outlet duct 140 are connected via a corner duct-connector 145 having a blunted corner angle for smoothing and reducing airflow turbulence flowing there-through.

This invention further discloses a method for configure a cooling system 100. The method includes the steps of a) conducting an air flow via an inlet air duct 120 along a first direction, i.e., the X-axis. The method further includes step b) of connecting a fan 110 to the inlet air duct 120 for blowing an outlet airflow at a direction different from the first direction. In a preferred embodiment, the step b) of blowing an outlet air flow at a second direction different from the first direction is a step of blowing the airflow at a second direction perpendicular to the first direction, i.e., along the Y-axis. In another preferred embodiment, the step a) of conducting an air flow via an inlet air duct along a first direction further includes a step a1) of placing a plurality of rectifying grid 125 in the inlet duct 120 for reducing air turbulence and noise of the airflow conducted through the inlet air duct 120.

Therefore, this invention provides a cooling system that includes an air flow guiding system and a fan to provide flexible space arrangement and reduced turbulence of the flow field to overcome the difficulties encountered in the prior art. Specifically, this invention provides a cooling system where the airflow guiding system allows the directions of the inlet and the outlet airflow to be in different non-parallel directions to allow flexible space arrangement. Furthermore, the airflow guiding system is provided with turbulence isolation partition such that the turbulence of the flow-filed is reduced. The airflow guiding system is formed with ducts designed with configuration to minimize airflow reflection thus reduces the flow-field turbulence. The fan is provided with a motor hanging from the wall of a duct in the airflow guiding system. The noise is reduced because the ribs for supporting the fan blades are no longer required and the noises from interference between the airflow and ribs are eliminated. The blades of the fan are configured to with the blade surface bent to have screw shape between adjacent blades to minimize the turbulence generated from the rotation of these blades. The blades are provided with notches at the front end of the blades. The reverse flow of the airflow due to a resistance to the blade rotation can be minimized such that the airflow turbulence can be further reduced. Additional air intake openings are also provided in the airflow guiding system such that the flow rate ban be increased. A higher cooling rate can be achieved by increasing the flow rate produced by the cooling system.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

What is claimed is:

1. A cooling system for temperature control comprising:

a fan and an airflow guiding system;

said airflow guiding system includes an inlet air duct for guiding the airflow along an elongated duct-section to said fan;

said inlet air duct includes turbulence reduction grid extended from an inlet of said air duct over an entire length of said elongated duct-section for separating the air duct into a plurality of isolated flow paths whereby the air turbulence is reduced.

2. The cooling system of claim 1 wherein:

said airflow guiding system further includes an outlet duct for incorporating said fan therein wherein said outlet duct and said fan are directed to a direction different from said elongated duct section separated by said turbulence reduction grid of said inlet air duct.

3. The cooling system of claim 2 wherein:

said outlet duct and said fan having an rotational axis directed to a direction perpendicular to said elongated duct-section of the inlet air duct; and said inlet air duct and said outlet duct are connected via a corner duct-connector having a blunted corner angle for smoothing and reducing airflow turbulence flowing there through.

4. The cooling system of claim 3 wherein:

said fan driven by a motor hung to the corner duct-connector and said motor rotating along a rotational axis perpendicular to said elongated duct-section of said inlet air duct whereby said fan is structurally supported only on said motor for reducing air turbulence.

5. The cooling system of claim 1 wherein:

said fan includes a plurality of blades and rotating along a rotational axis perpendicular to said elongated duct-section of said inlet air duct wherein each of said blades are configured to have a bending blade-surface constituting same direction screw shape for reducing airflow turbulence.

6. The cooling system of claim 5 wherein:

said fan further includes a rotatable outlet ring wherein said ring having a plurality of notches for further reducing airflow turbulence.

7. The cooling system of claim 1 wherein:

said inlet air duct further includes at least one opening in additional to an inlet opening for increasing a flow rate of the airflow to improve a cooling efficiency.

8. The cooling system of claim 1 wherein:

said fan having a plurality of fan-blades disposed substantially on a fan-blade-plane and rotating along a rotation axis perpendicular to said fan-blade-plane and substantially perpendicular to said elongated duct-section separated by said turbulence-reduction grids.

9. A cooling system for temperature control comprising:

a fan and an airflow guiding system;

said airflow guiding system includes an inlet air duct for guiding the airflow along an elongated duct-section to said fan;

said inlet air duct includes turbulence reduction grid extended from an inlet of said air duct over an entire length of said elongated duct-section for separating the air duct into a plurality of isolated flow paths whereby the air turbulence is reduced; and said fan further includes a rotatable outlet ring for rotating to an outlet-ring angular position and for directing said airflow blowing out from said fan to predefined directions according to said outlet-ring angular position.

10. A cooling system for temperature control comprising:

a fan with fan-blades disposed substantially on a fan-blade-plane and rotating along a rotation axis perpendicular to said fan-blade-plane;

an airflow guiding system;

said guiding system includes an inlet air duct for guiding an airflow along an elongated duct-section to said fan along a direction substantially perpendicular to said rotation axis and:

said inlet air duct further includes a plurality of turbulence reduction grids extended from an inlet of said air duct over an entire length of said elongated duct-section for separating the air duct into a plurality of isolated flow paths whereby the air turbulence is reduced.

11. The cooling system of claim 10 wherein:

said airflow guiding system further includes an outlet duct for incorporating said fan therein wherein said outlet duct and said fan are directed to a direction different from said elongated duct-section.

12. The cooling system of claim 11 wherein:

said outlet duct and said fan are directed to a direction perpendicular to said elongated duct-section of the inlet air duct; and said inlet air duct and said outlet duct are connected via a corner duct-connector having a blunted corner angle for smoothing and reducing airflow turbulence flowing there through.

13. The cooling system of claim 12 wherein:

said fan driven by a motor hung to the corner duct-connector and said motor rotating along a rotational axis perpendicular to said elongated duct-section of said inlet air duct whereby said fan is structurally supported only on said motor for reducing air turbulence.

14. The cooling system of claim 10 wherein:

said fan includes a plurality of blades and rotating along a rotational axis perpendicular to said elongated duct-section of said inlet air duct wherein each of said blades are configured to have a bending blade-surface constituting same direction screw shape for reducing airflow turbulence.

15. The cooling system of claim 14 wherein:

said fan further includes a rotatable outlet ring wherein said ring having a plurality of notches for further reducing airflow turbulence.

16. The cooling system of claim 10 wherein:

said inlet air duct further includes at least one opening in additional to an inlet opening for increasing a flow rate of the airflow to improve a cooling efficiency.

17. A cooling system for temperature control comprising:

a fan and an airflow guiding system;

said airflow guiding system includes an inlet air duct for guiding the airflow along an elongated duct-section to said fan;

said inlet air duct includes turbulence reduction grid extended from an inlet of said air duct over an entire length of said elongated duct-section for separating the air duct into a plurality of isolated flow paths whereby the air turbulence is reduced; and said fan further includes a rotatable outlet ring for rotating to an outlet-ring angular position and for directing said airflow blowing out from said fan to predefined directions according to said outlet-ring angular position.

18. A method for configure a cooling system comprising:

a) conducting an air flow via an inlet air duct along a first direction; and b) connecting a fan to said inlet air duct having a plurality of fan blades rotating along a rotational axis for blowing an outlet air flow at a direction along said rotation axis different from said first direction; and c) placing a plurality of turbulence reduction grids in said inlet air duct extending over an entire length of said inlet air duct to separate the air duct into a plurality of isolated flow paths for reducing air turbulence and noise of said airflow conducted through said inlet air duct.

19. The method for configure a cooling system of claim 18 wherein:

said step b) of blowing an outlet air flow at a direction along said rotational axis different from said first direction is a step of blowing said airflow at a direction perpendicular to said first direction.

20. The method for configure a cooling system of claim 18 further comprising:

d) driving said fan by a motor hung to a corner duct-connector connected between said inlet air duct and an outlet duct wherein said fan is structurally supported only on said motor hung on to said corner duct-connector.

* * * * *